US006681399B1

(12) United States Patent
Kerr

(10) Patent No.: US 6,681,399 B1
(45) Date of Patent: Jan. 27, 2004

(54) PROTECTIVE GARMENT

(76) Inventor: Andrew Robert England Kerr, 524 Hagley Road West, Birmingham B68 0B7 (GB)

( * ) Notice: Subject to any disclaimer, the term of this patent is extended or adjusted under 35 U.S.C. 154(b) by 0 days.

(21) Appl. No.: 09/980,678

(22) PCT Filed: Apr. 12, 1999

(86) PCT No.: PCT/GB99/01114

§ 371 (c)(1),
(2), (4) Date: Oct. 31, 2001

(87) PCT Pub. No.: WO00/51454

PCT Pub. Date: Sep. 8, 2000

(30) Foreign Application Priority Data

Feb. 27, 1999 (GB) ..... 9904534
Mar. 2, 1999 (GB) ..... 9904754

(51) Int. Cl.[7] ..... F41H 1/02; F41H 1/04
(52) U.S. Cl. ..... 2/2.5; 441/92; 441/107
(58) Field of Search ..... 441/88, 92, 96, 441/107; 2/2.25

(56) References Cited

U.S. PATENT DOCUMENTS 3,398,406 A * 8/1968 Waterbury ..... 2/2.5
4,864,656 A 9/1989 Nesse
4,964,404 A * 10/1990 Stone ..... 128/204.22
5,060,314 A * 10/1991 Lewis ..... 2/2.5
5,584,737 A 12/1996 Luhtala
5,813,891 A * 9/1998 McNamee ..... 441/108

FOREIGN PATENT DOCUMENTS

| | | |
|---|---|---|
| GB | 2214405 | 9/1989 |
| WO | WO 96/24816 | 8/1996 |
| WO | WO 97/27101 | 7/1997 |

* cited by examiner

*Primary Examiner*—John J. Calvert
*Assistant Examiner*—Robert H. Muromoto, Jr.
(74) *Attorney, Agent, or Firm*—Caesar, Rivise, Bernstein, Cohen & Pokotilow, Ltd.

(57) ABSTRACT

There are known proposals for protective garments comprising ballistic and stab resistant body armour and inflatable bags or bladders to give buoyancy. The improved garment of this invention has body armour and a gas inflatable bladder between the armour and the wearer's body so as to be shielded by the armour whilst being arranged not to harm the wearer when the bladder inflates. This is facilitated by regulating the inflation pressure and/or by providing expansion joints in the garment that allow the armour to move away from wearer's body to make room for the inflated bladder.

14 Claims, 3 Drawing Sheets

PROTECTIVE GARMENT

This invention relates to a garment comprising body armour. Such a garment might be worn by a member of the armed forces, police and so on.

The armour might comprise flexible penetration resistant material and/or, for extra protection, a rigid ceramic plate. The provision of buoyancy is useful in some situations and the prior art includes several proposals for garments comprising buoyant material such as foam sheets as well as armour.

U.S. Pat. 5,584,734 proposes a garment comprising pockets for receiving anti-ballistic inserts and buoyancy elements including an inflatable chamber.

According to the invention, there is provided a protective body garment comprising penetration resistant armour, a gas inflatable bag and inflation means for inflating the bag to provide buoyancy to a wearer of the garment when immersed in water, characterised in that the bag is arranged for extending between the armour and the wearer's body when the garment is being worn and the garment is such as to minimise harm to the wearer by pressure on the wearer's body when the bag is inflated by limiting said pressure.

Preferably the body armour comprises a plurality of components which are either flexible or flexibly connected together, whereby the armour expands on inflation of the gas bag. The garment may comprise portions interconnected by expansion joints which, when the bag inflates, permit said portions to move to provide room for the bag to expand, for example, the expansion joint could comprise folded strips of material connected between said portions.

Advantageously, the garment comprises valve means connected to said bag for limiting pressure in the bag when it is inflated.

The body armour may include a metal mesh layer and may comprise padding to reduce trauma.

Preferably the garment comprises automatic immersion sensitive inflation means for said bag.

In one preferred aspect the garment comprises an inner vest connectable to an outer jacket, for example, with zip fastener means for connecting the vest and jacket together. Preferably the vest and the jacket each comprise a gas inflatable bag and each bag has pressure limiting valve means connected thereto.

A specific embodiment of the invention will now be described by way of example with reference to the accompanying drawing in which.

Figure 2:
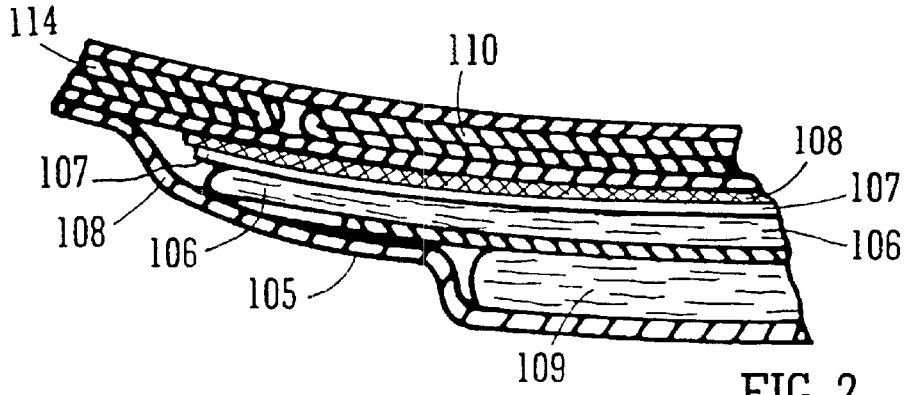
FIG. 2 is a section on the line III—III in FIG. 1.
Figure 3:
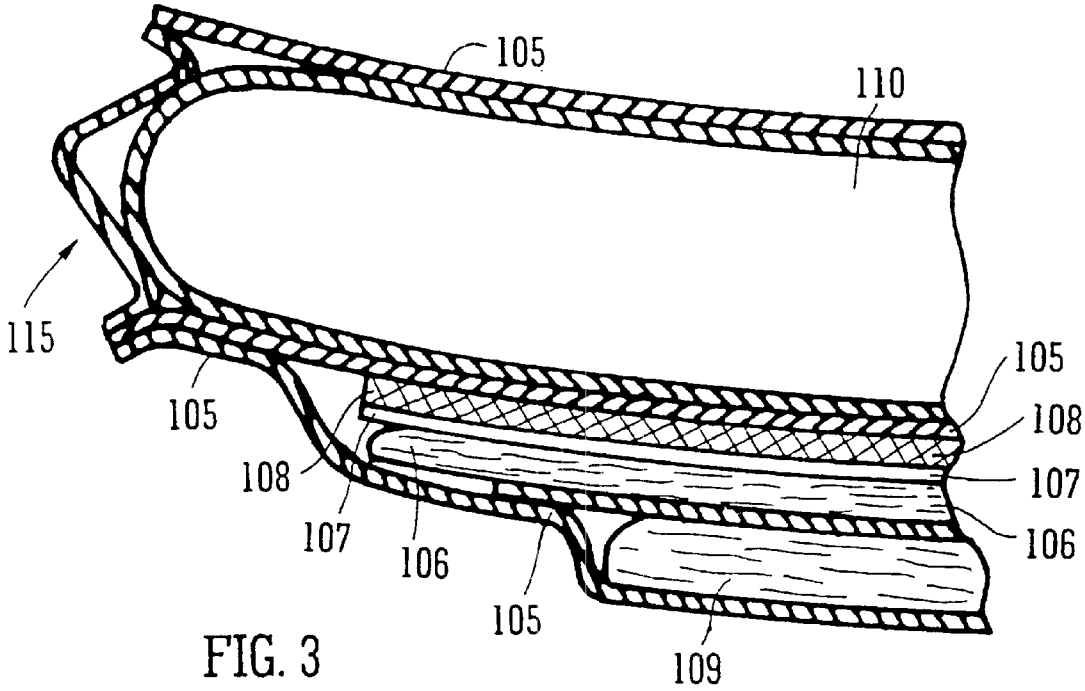

FIG. 3 corresponds to FIG. 2 but showing a bladder used in the vest in its inflated state.

Figure 1:
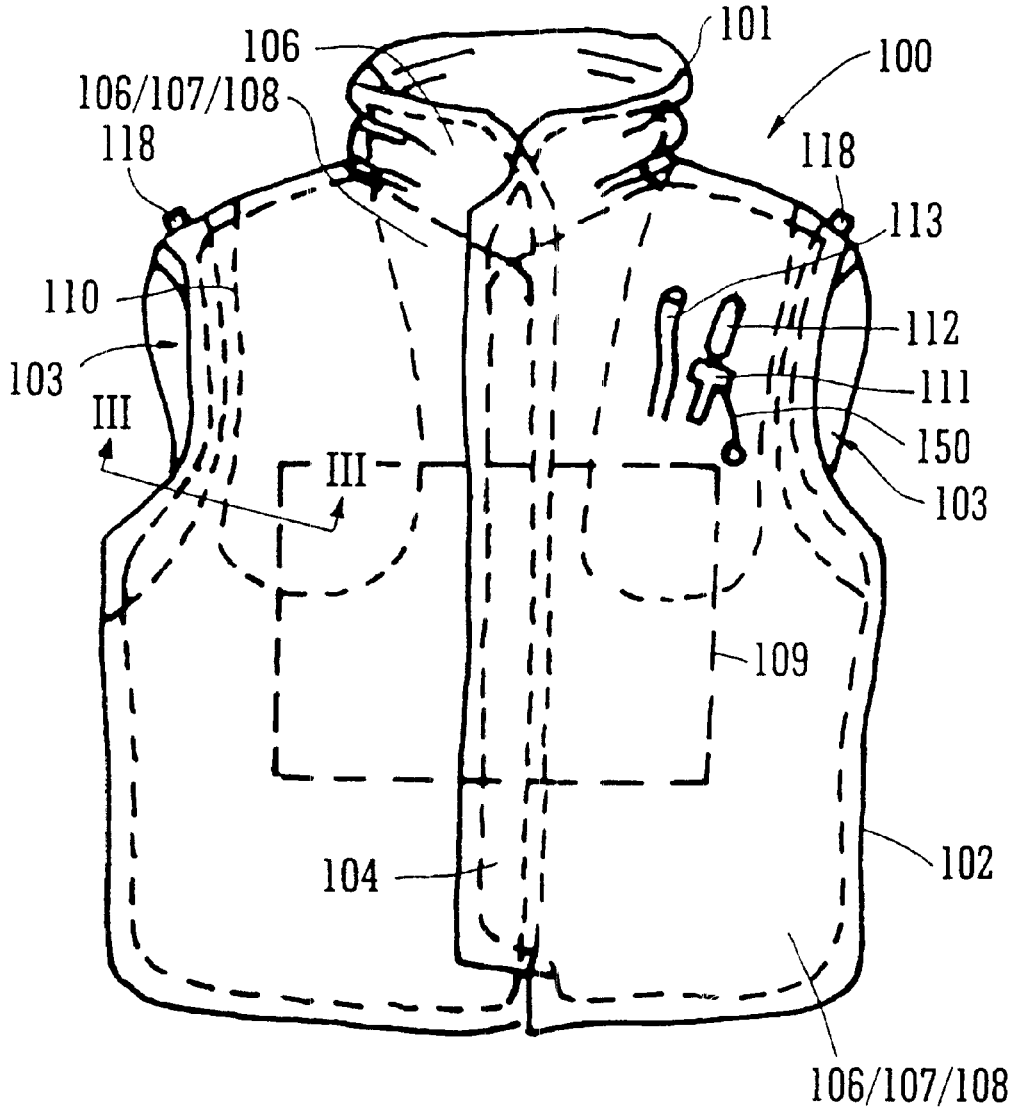
FIG. 1 is a front elevation of a protective sleeveless jacket or "vest"
Figure 4:
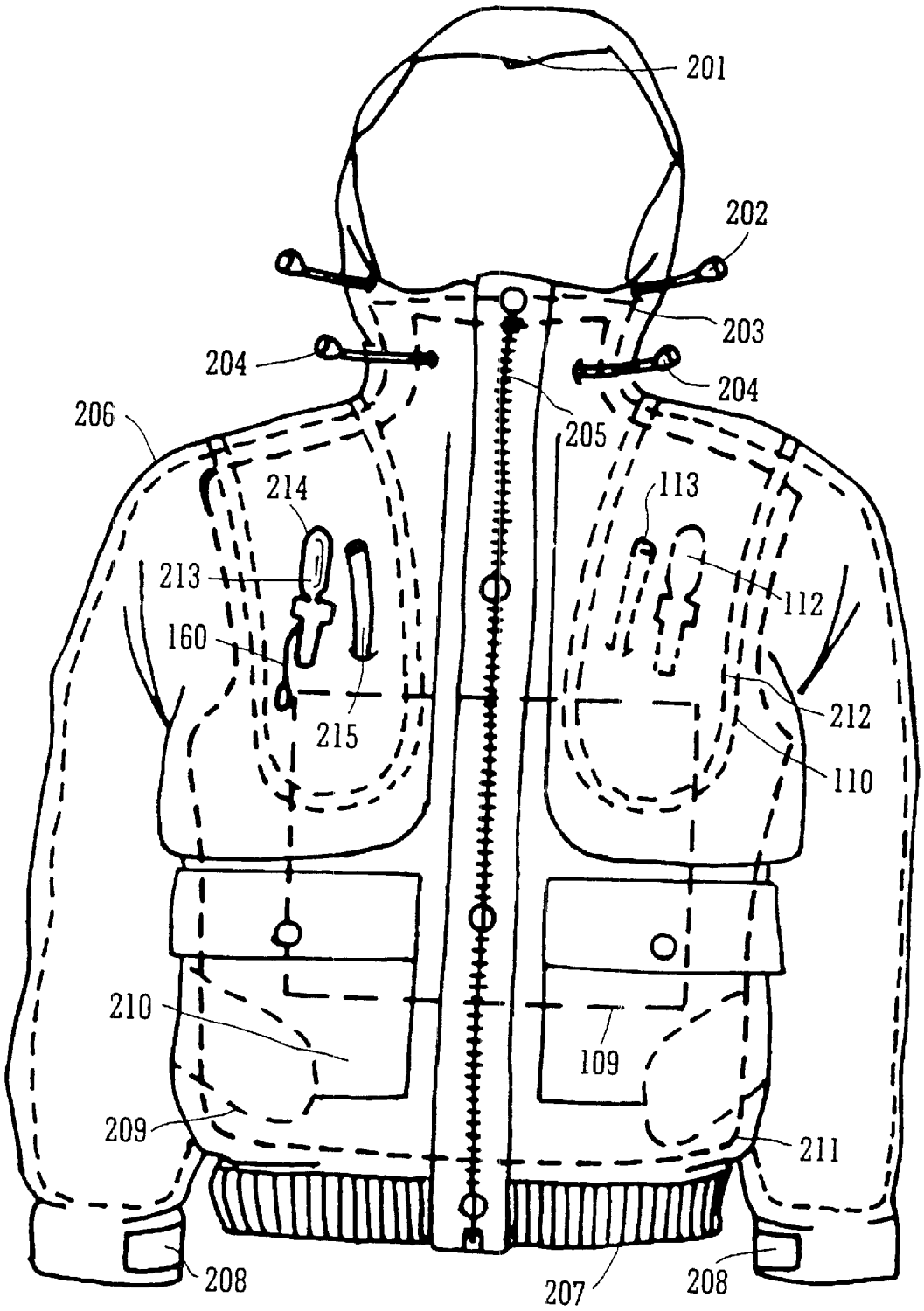

FIG. 4 is a front elevation of a weatherproof jacket worn in association with the FIG. 1 vest.

The sleeveless jacket or vest 100 of FIGS. 1 to 3 comprises a high collar 101 and a body 102 with armholes 103. The vest is openable down the front by way of a Velcro or zip fastener (not shown) concealed behind an overlapping lapel 104 on one side of the vest. At the sides of the vest, below the arm-holes 103 there could be provided 5 adjustment means (not shown) for example openable seems joined by Velcro fasteners.

The vest comprises layers of material 105 such as Nylon or p.v.c. enclosing flexible body armour. The body armour comprises padding 106, made up of layers of Kevlar, a layer of relatively flexible plastics material 107, and a layer of steel mesh 108. The Kevlar padding (and plastics material if desired) extends up into the collar 101 whilst the steel mesh stops just below the collar. However, there could be a separate padding member or rigid bullet-proof member (not shown) that can be removably fitted in the collar. The plastics material 107 which could be backed with semi-rigid plastics foam (not shown) acts as a so-called trauma pack, i.e. which spreads the pressure due to weapon contacts and helps reduce bruising. The mesh 108 helps to resist knife attacks. As well as the flexible body armour respective rigid bullet-proof plates or shells 109 can be removably fitted in pockets formed in the front and back of the vest. These plates could comprise ceramic or steel for example. Further padding or rigid armour members (not shown) can be fitted over the shoulders of a wearer of the vest 100, appropriate fasteners (e.g. VELCRO strips) 108 being provided on the shoulders of the vest.

The particular make up of the body armour can be chosen as desired. For example, the steel mesh 107 may not be appropriate sometimes or the armour could comprise plastics foam material (not shown). The rigid plates 109 may not be necessary or the pockets for them can be fitted so that the wearer can use the plates if he wants to, or if not, he can just leave the relevant pocket empty.

Also incorporated into the vest, there is an inflatable flotation bladder 110 which extends up from the front of the vest at one side then over the shoulder at this side and across to the other side of the vest at the top of the wearer's back, then back over the other shoulder and down at the other side of the front of the vest. When required, the bladder can be inflated by an immersion-responsive automatic inflation device 111, incorporating a compressed-gas bottle 112 and a manual override facility, such as a pull cord 150. The device 111 automatically inflates the bladder 110 when the device 111 is immersed but not if only splashed by spray or a wave. Meanwhile, if required, the cord pull can be operated to cause the device 111 to inflate the bladder 110 even if it is not immersed. The device 111 may be of the kind known and commercially available for use in inflatable life jackets. The bladder may also be inflated or topped-up when necessary by a mouth tube 113 with a non-return valve (not shown). Both the device 111 and tube 113 are mounted on the front of the vest so as to be easily available for operation by the wearer but, if preferred, could be concealed, say in or behind suitable pockets or flaps (not shown) provided in the vest.

The bladder 110 is located between the body armour 106 and the internal surface of the vest, i.e. between the armour and the body of the wearer, so as to lessen the chance of weapon damage to the bladder. To provide room for the bladder to inflate and expand inwardly folded strips of material 114 are provided around the armholes 103 to form expansion joints 115 as shown best in FIGS. 3 and 4. When the bladder 110 inflates, the strips 114 are unfolded and pushed outwardly by the bladder. These joints enable the armour 106 to move away from the wearer's body and permit the bladder 110 to expand outwards and sideways as shown. Further expansion joints like the joints 115 may be provided elsewhere, for example, at the back of the vest just below the collar 101.

The bladder is designed, specifically by extending round the back of the jacket just below collar 101 and down at each side of the jacket front, to tend to self-right an unconscious person wearing the vest.

Referring to FIG. 4, if required, the vest 100 may be worn under a weatherproof outer jacket 200 which comprises a peaked brim detachable hood 201 made of super strength microfibre having adjustable draw cords 202 for the hood. The jacket 200 comprises a high collar 203 made of Polartec fleece and having adjustable draw cords 204. The jacket has a concealed front zip 205 and sealed seams 206 to maximise water protection, an elasticated waist 207 for maximum movement, and adjustable cuffs 208. It also has Polartec lined hand warmer pockets 209 and large bellows pockets 210 with drain holes (not shown). An inner fleece lining 211 is present for thermal protection.

If required, the jacket 200 and vest 100 could be connected together by a zip for Velcro fastener (not shown), i.e. the vest can be formed as an inner liner to the outer jacket 200.

Like the vest 100, the jacket 200 comprises a flotation bladder 212 which extends round behind the top of the back of the jacket and down at each side of the jacket front. The bladder 212 is provided with an immersion sensitive automatic inflation device 213 with compressed gas bottle 214 and a pull cord 160 for manual override. The bladder is also provided with a mouth-tube 215 connected to the bladder via a non-return valve (not shown) for inflating or topping-up the bladder orally. The bladder 212, device 213 and tube 215 are similar to the corresponding parts 110, 111 and 113 of the vest 100. As with the vest, the device 213 and tube 215 of the jacket 200 can be mounted on the front of the jacket for easy availability or concealed behind a suitable flap or in a pocket or the like.

For preference, each inflation device 111 and 213 comprises a sensitive servo-valve that regulates the pressure in the respective bladder. Then the two inflation devices and corresponding valves can operate together while better regulating the overall buoyancy effect and avoiding overpressure.

The outer jacket could also comprise relatively soft body armour and/or rigid bullet-proof plates if desired. If so, then the jacket may be provided with expansion joints similar to the joints 115 shown in FIGS. 1 to 3.

The inner bladder is protected from bullet fragmentation, stab attack or the like by the body armour.

Upon the inflation units being activated they will expand with the body armour being raised to allow expansion of surrounding body armour. In the event of a wearer using an item or being subject to other confined conditions, the armour will not inflate to an extent as to crush the occupant.

Whether or not both inflation bladders are provided, the inflation device being operable as a pressure regulating servo-valve is useful because it prevents over inflation in say the case of the vest 100 and prevents harm to the wearer of the vest. In other words, regulation of bladder pressure by the servo-valve forms an additional or alternative means, over and above the expansion joints 115, for preventing or ameliorating harm to the wearer.

What is claimed is:

1. A protective body garment comprising:

(a) a vest having a body having arm holes, the vest having an internal surface and an external surface, the vest having a front that, when worn, is adjacent to a wearer's chest and stomach, sides that, when worn, are adjacent to the wearer's sides, a back that, when worn, is adjacent to the wearer's back, and a pair of shoulders that, when worn, are above the wearer's shoulders;

(b) penetration resistant armour located under the external surface of the vest;

(c) an inflatable flotation bladder in the form of a bag between the inner surface of the vest and the penetration resistant armour, the bag extending from the front of the vest at one side of the vest, over one of the pair of vest shoulders, across the vest back, then back over the other one of the pair of vest shoulders and down the front of the vest at the other side of the vest;

(d) expansion joints in the form of folded strips of material located around the arm holes such that, when the bag is in an inflated condition, the strips are unfolded and pushed outwardly, to provide buoyancy to the wearer of the garment when immersed in water; and (e) a pressure-regulating device to limit the pressure of the gas in the bag when the bag is inflated to minimize harm to the wearer by pressure on the wearer's body.

2. The garment according to claim 1, wherein the armour comprises a plurality of components which are either flexible or flexibly connected together, whereby the armour expands on inflation of the bag with gas.

3. The garment according to claim 1, wherein the pressure-regulating device includes a valve member connected to the bag for limiting pressure in the bag when said bag is inflated.

4. The garment according to claim 2, wherein the pressure-regulating device includes a valve member connected to the bag for limiting pressure in the bag when said bag is inflated.

5. The garment according to claim 1, wherein the pressure-regulating device includes a valve member connected to the bag for limiting pressure in the bag when said bag is inflated.

6. The garment according to claim 1, wherein the armour includes padding to reduce trauma.

7. The garment according to claim 2, wherein the armour includes padding to reduce trauma.

8. The garment according to claim 1, wherein the armour includes padding to reduce trauma.

9. The garment according to claim 3, wherein the armour includes padding to reduce trauma.

10. The garment according to claim 1, wherein the inflatable flotation bladder includes automatic water immersion sensitive inflation means for the bag.

11. The garment according to claim 2, wherein the inflatable flotation bladder includes automatic water immersion sensitive inflation means for the bag.

12. The garment according to claim 1, wherein the inflatable flotation bladder includes automatic water immersion sensitive inflation means for the bag.

13. The garment according to claim 1, comprising an inner vest connectable to an outer jacket.

14. The garment according to claim 3, said vest and jacket each comprising a gas inflatable bag and a pressure regulating device for regulating the pressure within each bag.

* * * * *